US006182888B1

(12) United States Patent
Ljungström

(10) Patent No.: US 6,182,888 B1
(45) Date of Patent: Feb. 6, 2001

(54) 45 DEGREE OFF-SET TOP SEAL CARTON

(75) Inventor: Tommy Bo-Goran Ljungström, Höör (SE)

(73) Assignee: Tetra Laval Holdings & Finance, SA, Pully (CH)

( * ) Notice: Under 35 U.S.C. 154(b), the term of this patent shall be extended for 0 days.

(21) Appl. No.: 09/151,972

(22) Filed: Sep. 11, 1998

(51) Int. Cl.[7] ..... B65D 5/06

(52) U.S. Cl. ..... 229/125.42; 229/104; 229/109; 229/137

(58) Field of Search ..... 229/104, 109, 229/110, 137, 138, 125.42

(56) References Cited

U.S. PATENT DOCUMENTS

| | | | | |
|---|---|---|---|---|
| 2,047,804 | | 7/1936 | Shapiro . | |
| 3,907,194 | | 9/1975 | Davenport et al. . | |
| 4,313,556 | | 2/1982 | Boyle et al. . | |
| 4,546,915 | * | 10/1985 | Lisiecki | 229/137 |
| 4,630,733 | | 12/1986 | Fear . | |
| 5,029,751 | | 7/1991 | Detzel | 229/125.42 |
| 5,337,538 | * | 8/1994 | Ljungstrom | 229/137 |
| 5,474,232 | * | 12/1995 | Ljungstrom et al. | 229/137 |
| 5,531,375 | * | 7/1996 | Palm | 229/109 |
| 5,738,272 | | 4/1998 | Anchor et al. | 229/109 |
| 5,871,144 | * | 2/1999 | Anchor et al. | 229/137 |

* cited by examiner

*Primary Examiner*—Gary E. Elkins
(74) *Attorney, Agent, or Firm*—Welsh & Katz, Ltd.

(57) ABSTRACT

The present invention is a carton having a forty-five degree off-set seal from its bottom and a blank therefor. The carton may have a square cross-section or an octagonal cross-section. The forty-five degree off-set seal allows for a stiffer package and material savings of up to seven percent over a traditional gable top carton. A method and apparatus for fabricating the forty-five degree off-set seal are also disclosed herein.

5 Claims, 9 Drawing Sheets

45 DEGREE OFF-SET TOP SEAL CARTON

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to cartons. Specifically, the present invention relates to gable top cartons and carton blanks therefor.

2. Description of the Related Art

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically begin as generally rectangular carton blanks made of a laminated paperboard or similar material. The carton blanks are provided with a number of creases to facilitate folding and forming the blank into a rectangular carton having the characteristic gabled top.

When fully folded, filled, and sealed, the gable top cartons included a gabled top structure that engages four side-panels. Traditionally, each side panel is generally perpendicular to each adjacent side panel. The panels are each divided from one another by a single vertical score line extending the entire height of the side wall. These side panels form the characteristic hollow rectangular body of the container and define the volume of product that a carton may hold. In accordance with accepted design approaches, the design of a traditional gable top carton to accommodate a specified volume involves adjusting the dimensions of the four side walls defining the rectangular body that is to contain the specified volume. Very often, these product volume requirements are specified by the packager and selected from standard volumes that have been deemed accepted in the consumer market for the product (i.e., pint, quart, half gallon, gallon, half liter, liter, etc.). When this design approach is utilized, there exists a generally established relationship between the surface area of the carton blank and the carton volume. The surface area of the carton, and particularly the area of the four side walls constituting the bulk of the surface area, is thus generally fixed for a given container volume.

Additional end panel extensions and end panel shapes are often employed to assist in folding and sealing the traditional gable top cartons. These added extensions and shapes result in added carton surface area per unit volume of product.

The traditional approaches to gable top carton design have heretofore devoted little effort to optimizing the carton surface area per unit volume of product.

BRIEF SUMMARY OF THE INVENTION

The present invention is a carton with a 45 degree off-set top seal. The off-set top seal allows for the stiffening of the side panels by the bottom corners, and also increases the carton's volume. There is also a possible material saving of seven percent for a carton.

One aspect of the present invention is a traditional gable top carton with the off-set seal. Another aspect is an eight-sided carton with an off-set top seal. Yet another aspect of the present invention is a method and apparatus of fabricating the off-set top seal carton. Still another aspect of the present invention is a carton blank for fabricating a carton with a forty-five degree off set top seal.

It is a primary object of the present invention to provide a carton with an off-set top seal.

It is a further object of the present invention to provide a multi-sided carton with an off-set top seal.

It is a further object of the present invention to provide a blank for an eight-sided carton with an off-set top seal.

It is a further object of the present invention to provide a blank for a carton with an off-set top seal.

It is a further object of the present invention to provide a method and apparatus of fabricating a carton with an off-set seal.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a folded and sealed carton of the present invention.

Figure 2:
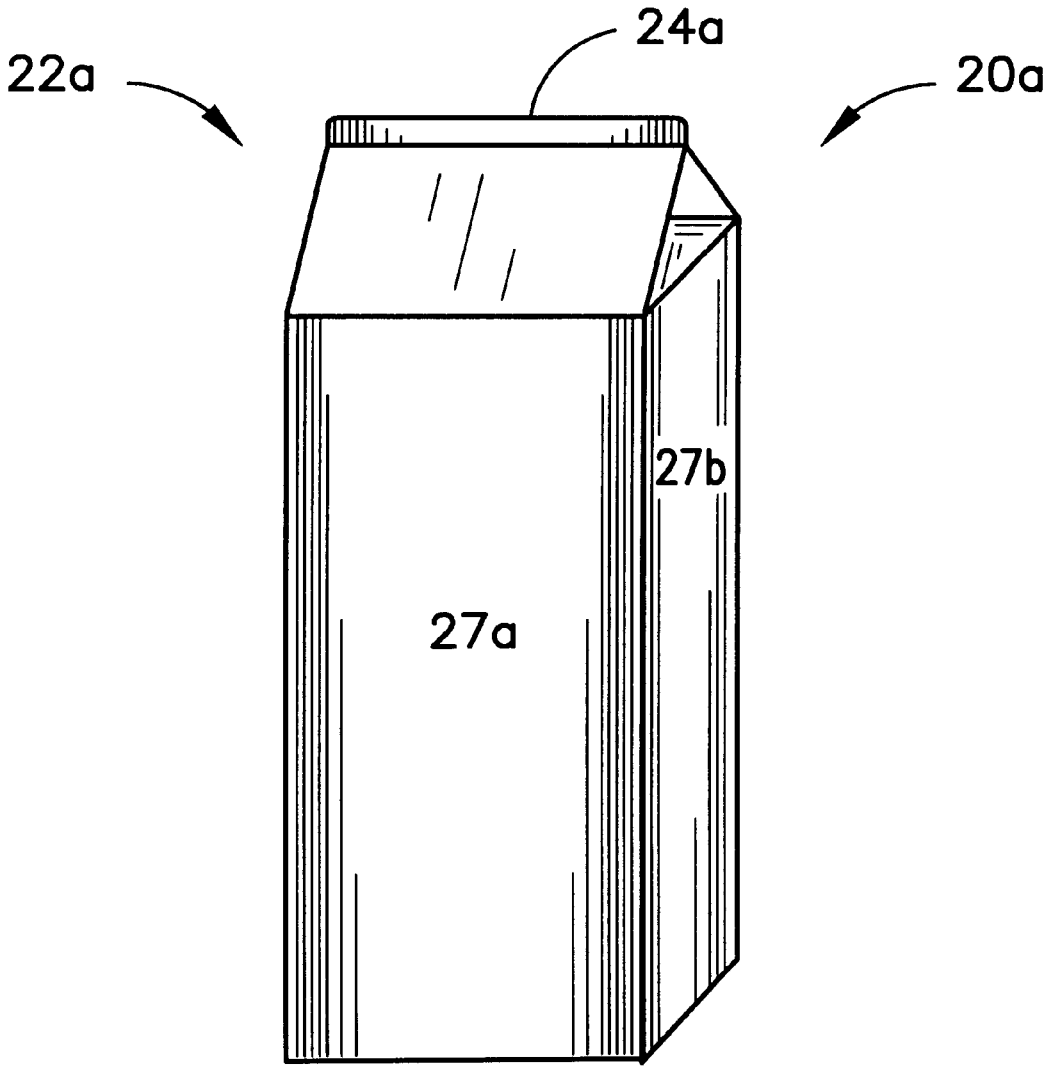
FIG. 2 PRIOR ART

There is illustrated in FIG. 2 a perspective view of a folded and sealed carton of the prior art.

Figure 1:
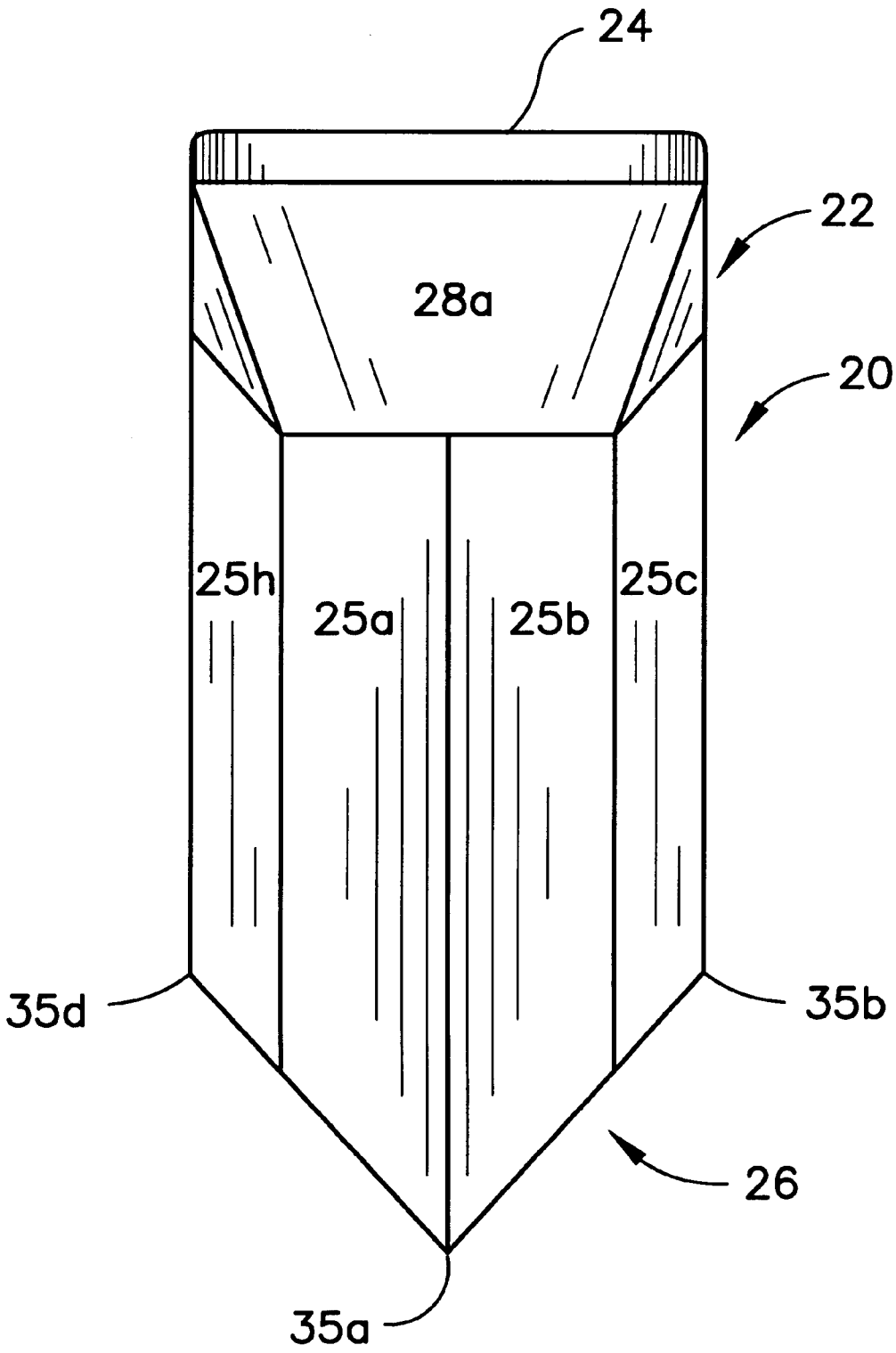
Figure 3:
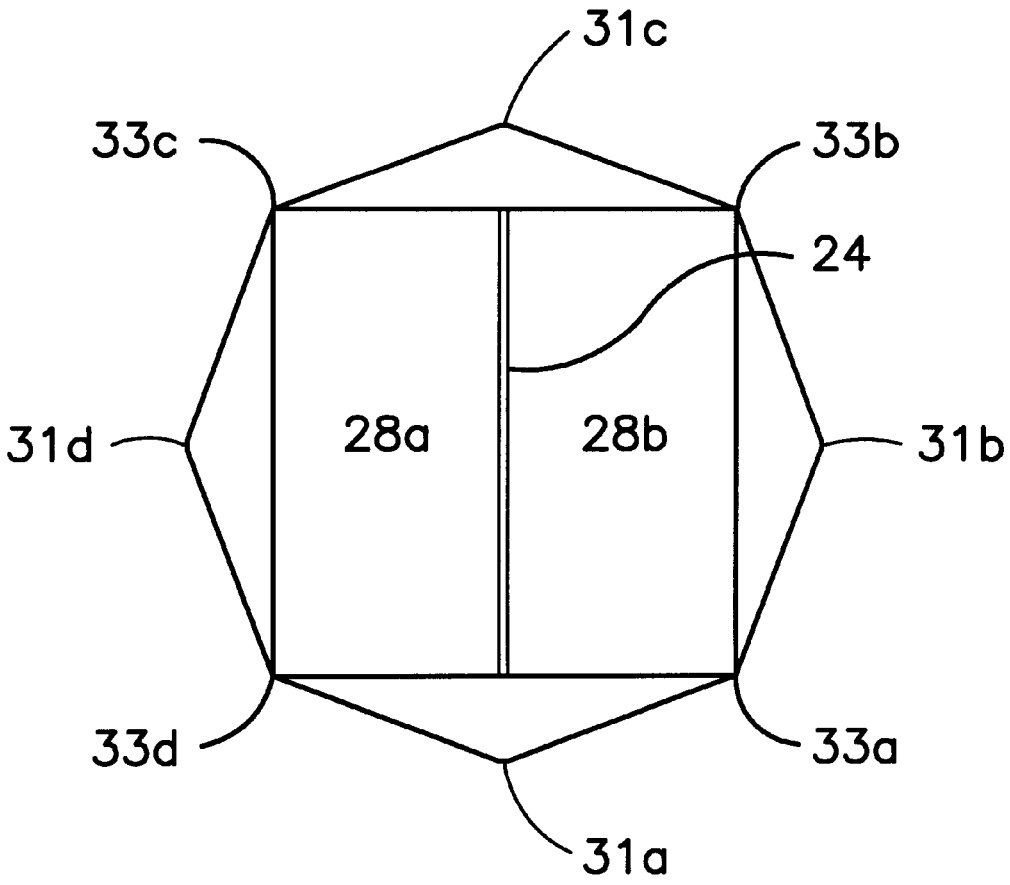

There is illustrated in FIG. 3 a top plan view of the carton of FIG. 1.

Figure 4:
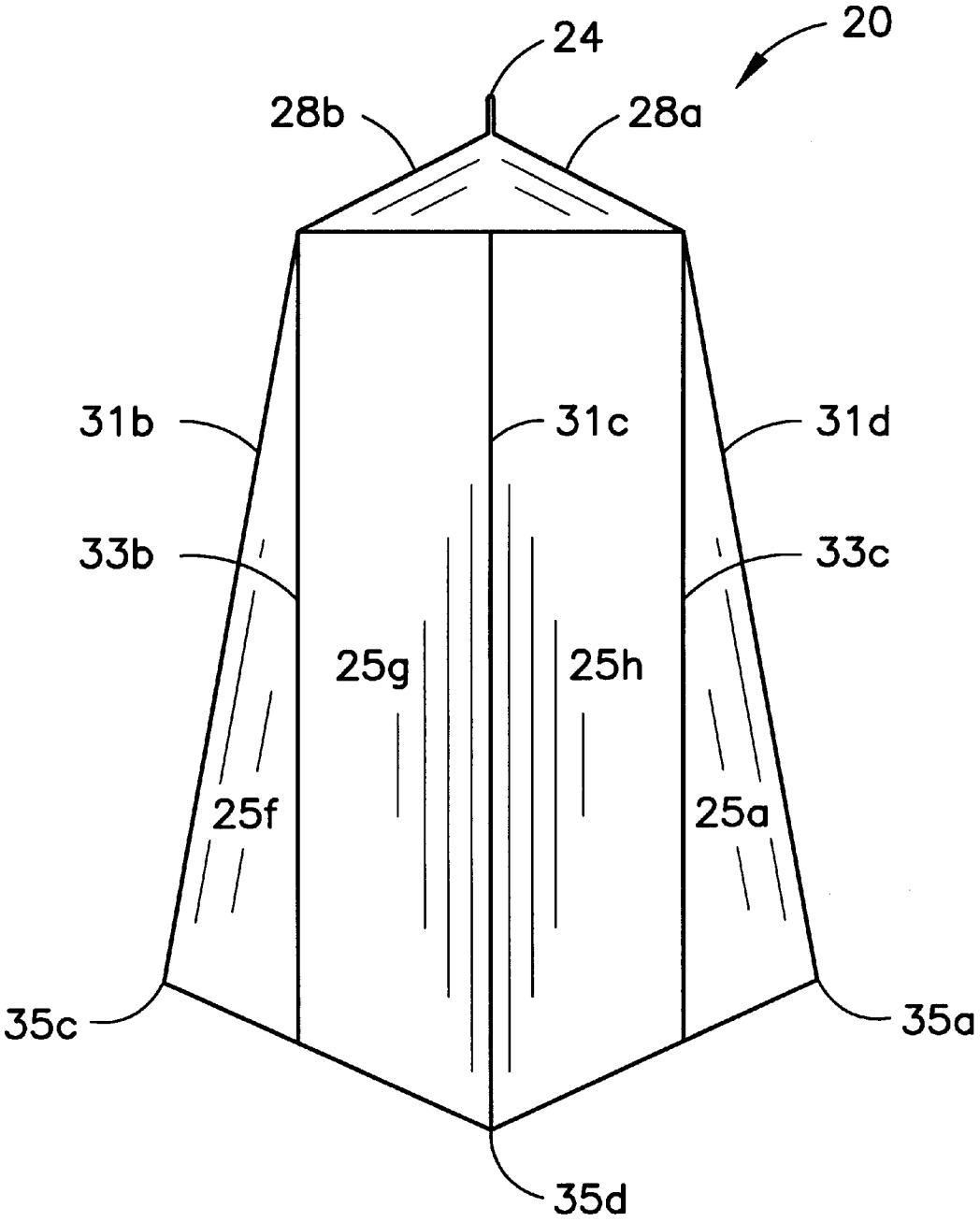

There is illustrated in FIG. 4 a front plan view for the carton of FIG. 1.

Figure 5:
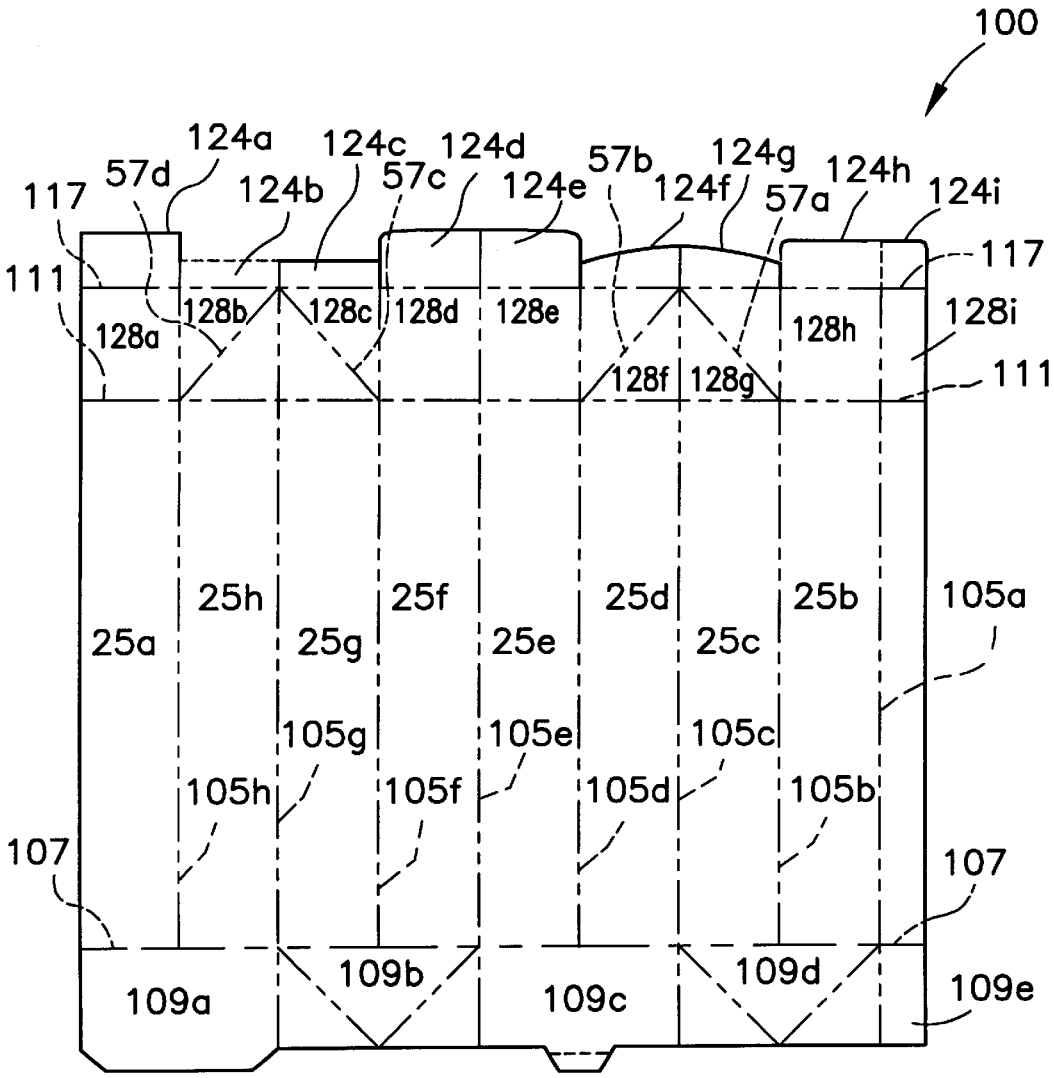

There is illustrated in FIG. 5 a blank for the carton of FIG. 1.

Figure 6:
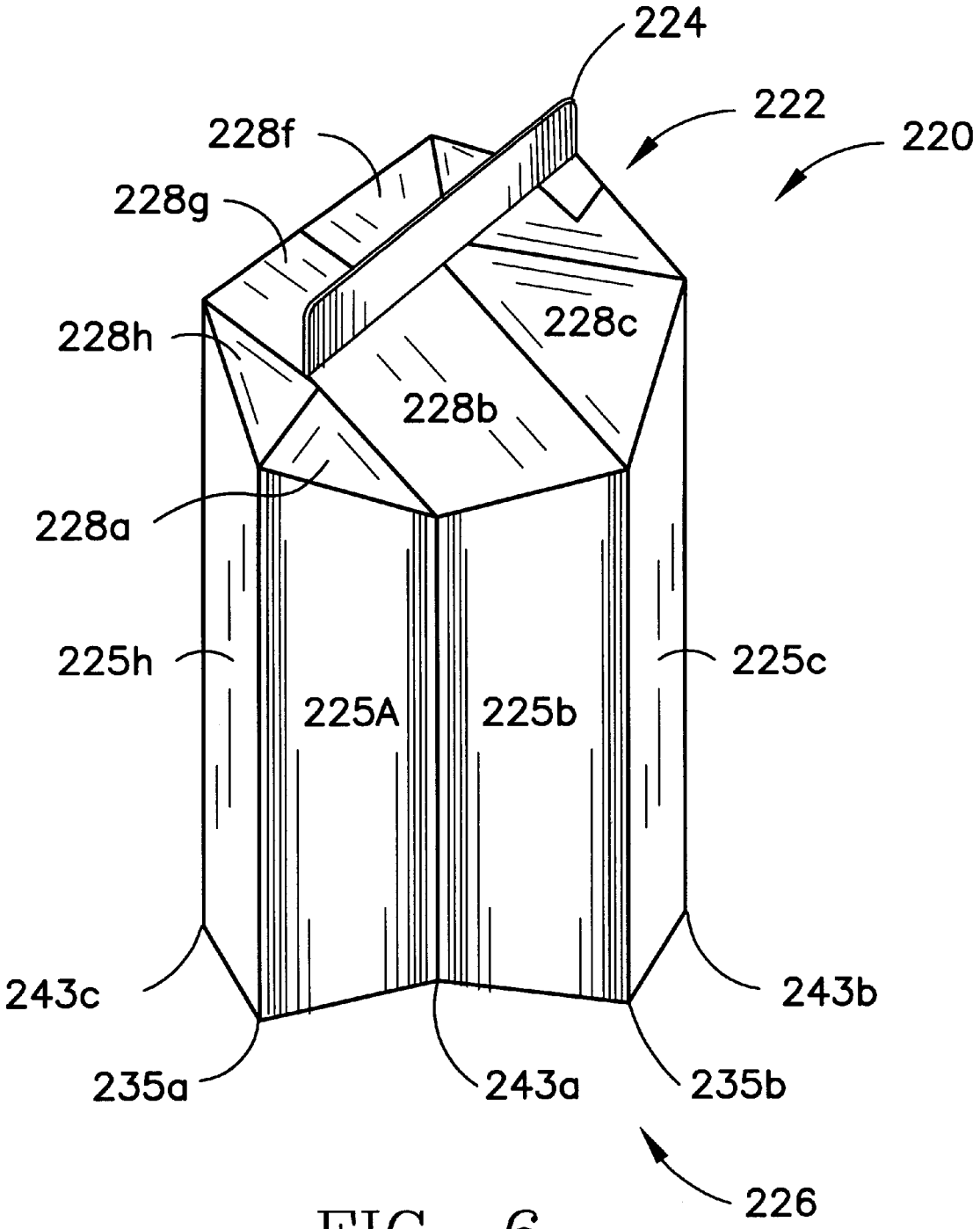

There is illustrated in FIG. 6 a perspective view of a folded and sealed carton of the present invention.

Figure 7:
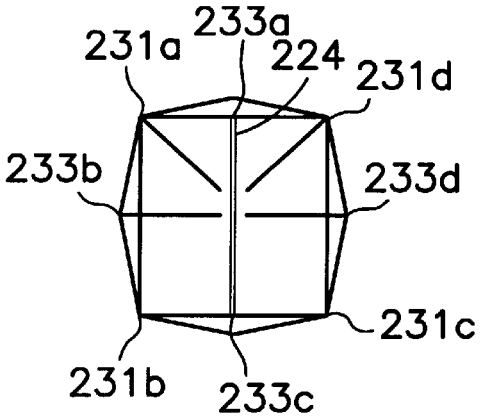

There is illustrated in FIG. 7 a top plan view of the carton of FIG. 6.

Figure 8:
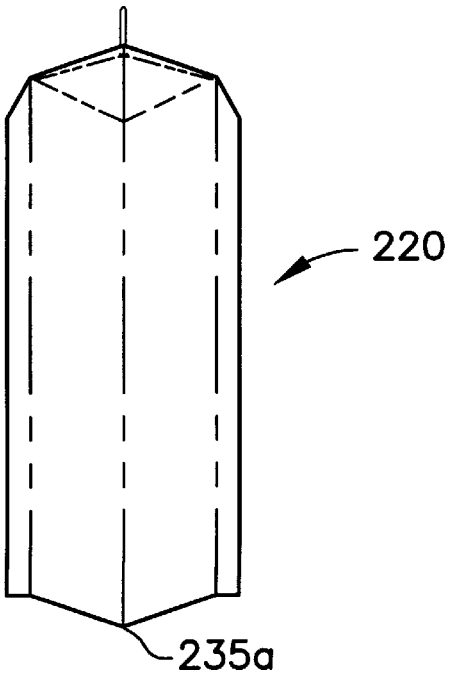

There is illustrated in FIG. 8 a front plan view for the carton of FIG. 6.

Figure 9:
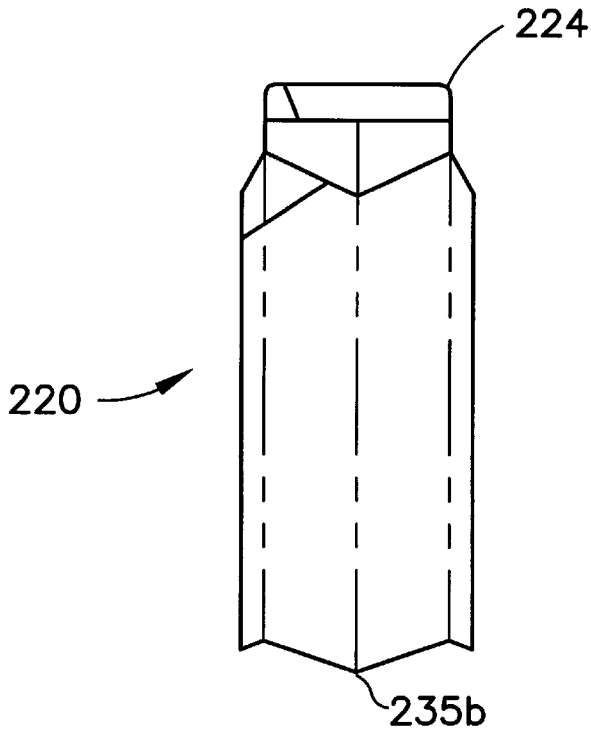

There is illustrated in FIG. 9 a side plan view of the carton of FIG. 6.

Figure 10:
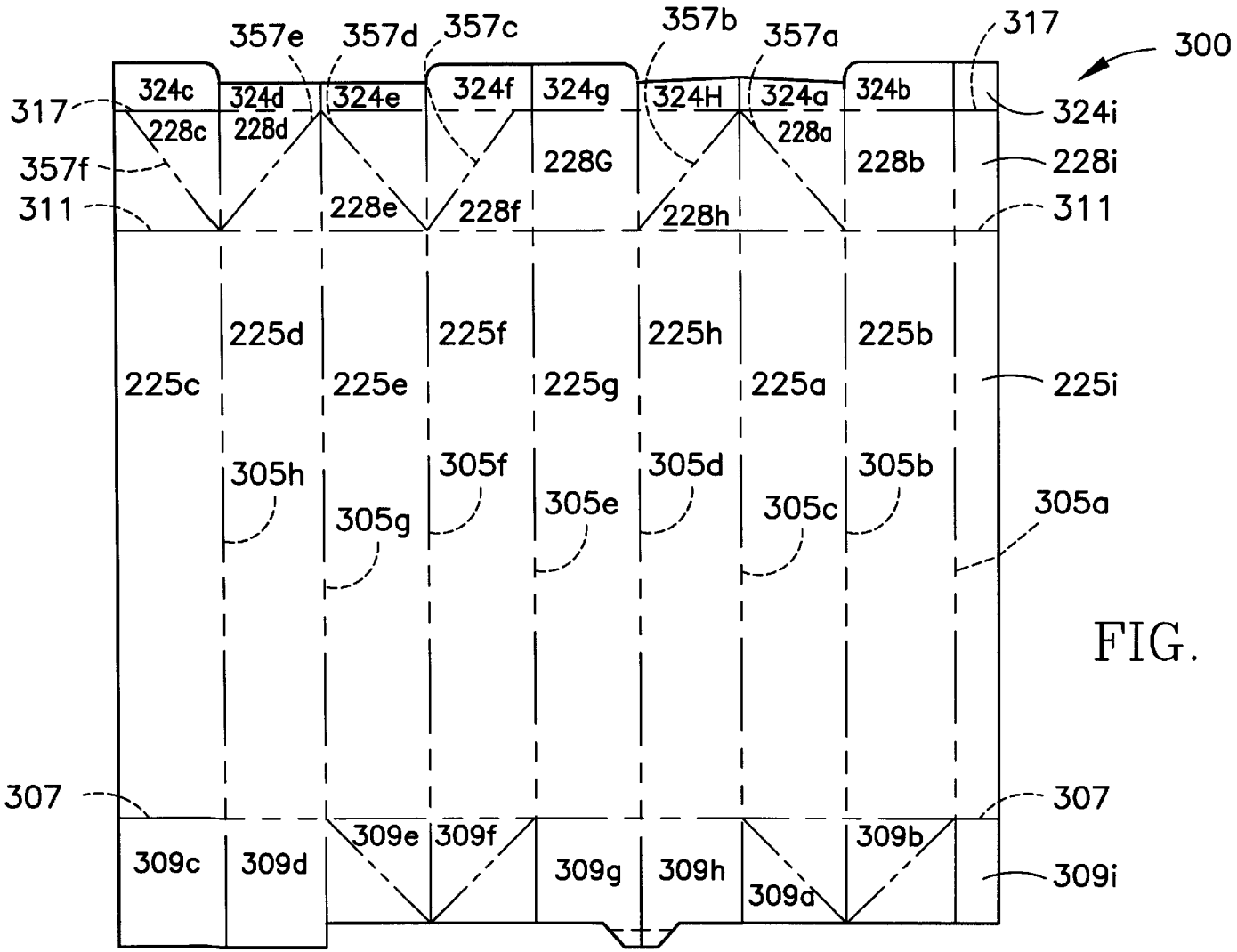

There is illustrated in FIG. 10 a blank for the carton of FIG. 6.

Figure 11:
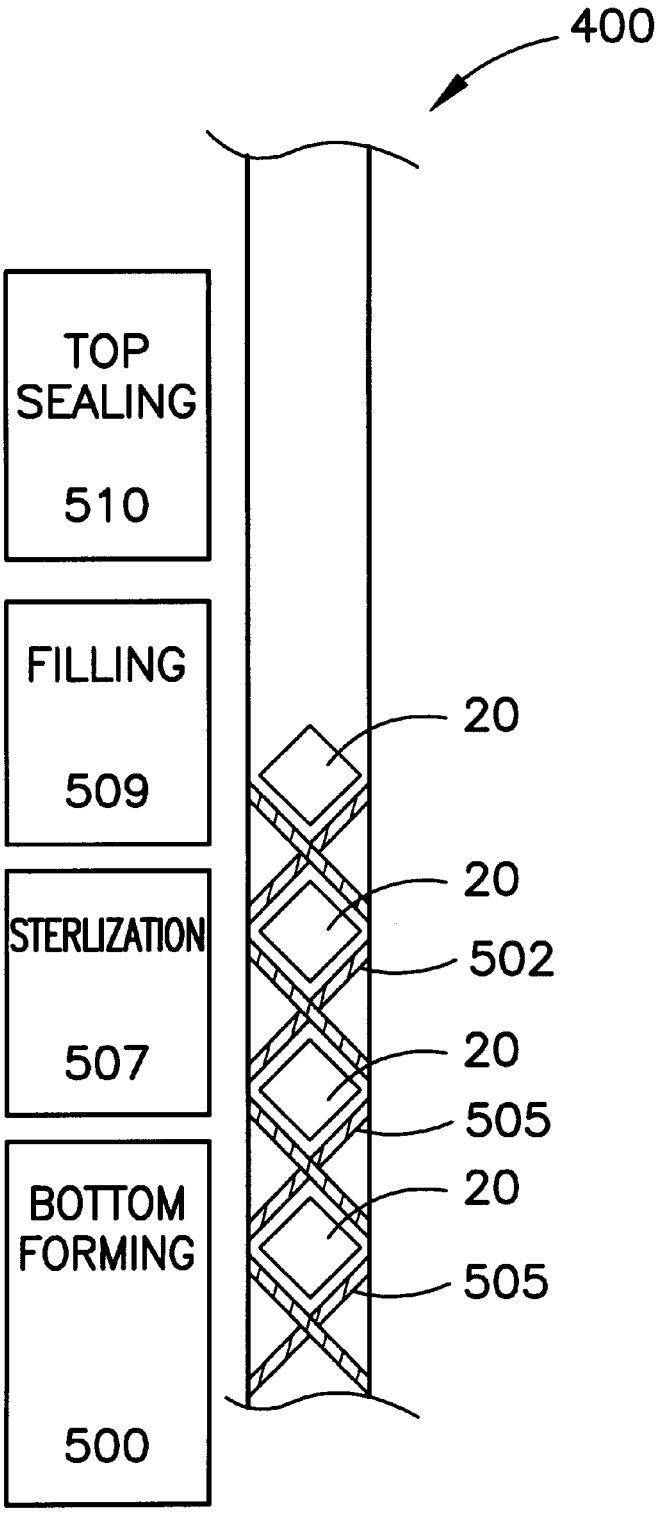

There is illustrated in FIG. 11 a top plan schematic view of a packaging machine for fabricating the carton of the present invention.

DETAILED DESCRIPTION OF THE INVENTION

A carton 20 with a forty-five degree off-set top seal is shown in FIG. 1. The carton 20 has a gable top 22 with a top fin 24 arising from a pair of top panels 28*a–b*. The gable top 22 crowns a plurality of side walls 25*a–h* that engage to form a bottom 26 with a square cross-section. The carton 20 of the present invention has its gable top 22 off-set forty-five degrees relative to the bottom 26 as compared to a typical gable top carton 20*a* which is shown in FIG. 2. The prior art gable top carton 20*a* has its top fin 24*a* parallel to a side wall 27*a* whereas in the present invention the top fin 24 is at an angle to the side walls 25*a–h*. The off-set top seal creates a pseudo eight sided carton 20*a*, generally about the middle of the side walls 25*a–h*. This eight-sidedness is best seen in FIG. 3 in reference to the apices 31*a–d* and the edges 33*a–d* formed by the intersection of the adjacent side walls 25*a–h*. For instance, side wall 25*h* is defined by apex 33*c* and edge 31*c* while side wall 25*a* is defined by apex 33*c* and edge 31*d*. Near the bottom of the carton 20, the side walls 25*h* and 25*a* are essentially one side wall, however, near the middle (the middle defined as the midpoint between the top and bottom of the carton) side walls 25*h* and 25*a* are essentially two side walls.

The rotation allows for the bottom corners 35*a–d* to be used to stiffen the side walls 25*a–h* and increase the overall volume of the carton 20. The rotation may also result in a material surface reduction of six to seven percent of the overall carton 20. This material savings may lower the cost of the carton 20 while still providing a carton 20 that is capable of containing an equal volume of product.

A possible carton blank for creating such a carton 20 is set forth in FIG. 5. The carton blank 100 generally has a structure of a fiberboard base with polyethylene coatings on the surfaces. Other film structures may employ the use of barrier layers, or non-scalping polymer coatings. The carton blank 100 is defined by various score lines that allow for folding of the blank 100 to create the carton 20 of FIG. 1. A plurality of vertical score lines 105*a–h* separate the side walls 25*a–h* from each other. A lower horizontal score line 107 separates the side walls 25*a–h* (which be designated side panels in the blank form) from a plurality of bottom panels 109.

An upper horizontal score line 111 separates the side walls 25*a–h* from a plurality of top panels 128*a–i*. A fin horizontal score line 117 separates the plurality of top panels 128*a–i* from the plurality of fin panels 124*a–i*. The top panels 128*d* and 128*e* form the top panel 28*b* of FIG. 1 and the top panels 128*a* and 128*b* form the top panel 28*a*. The top fin 24 is formed by the top fin panels 124*a*, 124*d*, 124*e*, 124*h* and 124*i*. The top fin panels 124*a*, 124*d*, 124*e*, 124*h* and 124*i* all have a maximum length that is greater than that of the top fin panels 124*b*, 124*c*, 124*f* and 124*g*. The unique top fin panel arrangement allows for the forty-five degree off-set sealing of the carton 20.

An alternative embodiment of the present invention is illustrated in FIGS. 6–10. The carton 220 of FIGS. 6–9 is for an eight-sided carton as set forth in U.S. Pat. No. 5,871,144 to Anchor et. al., entitled Eight-Sided Gable Top Carton which is hereby incorporated by reference. The difference between that the carton of the above-noted patent to Anchor et al. and the carton 220 of FIG. 6 is the gable top 222 of the carton 220 is off-set forty-five degrees from the bottom 226. The carton of the above-noted patent to Anchor et al. has the top fin in alignment with an inverted apex on the bottom while the carton 220 has its fin 224 in alignment with a bottom corner 235*a*.

The side walls 225*a–h* are separated from each other by the four edges 231*a–d* and four apices 233*a–d*. Unlike the embodiment of FIG. 1, the carton 220 of FIG. 6 is configured to have eight sides defined from the edges and apices, which are formed from additional vertical score lines extending from the top of the carton blank to the bottom as described below in reference to FIG. 10. The carton 20 of FIG. 1 is proved with eight-sidedness due to the forty-five degree off-set seal. Each apex of the apices 233*a–d* extends outward from the carton 220 thereby forming the most distant line/point on each of the sides.

Not only do the apices 233*a–d* provide an unique shape to the carton 220, the apices 233*a–d* allow for a greater volume per surface area of the carton 220 as compared to a traditional flat four-sided carton. The forty-five degree off-set seal further increases the volume per surface area of the carton 220 creating a carton with an optimum volume per surface area. Thus, the carton 220 will provide the consumer with the same volume of product as a traditional carton while using much less material. The carton 220 is also more grippable than typical cartons.

A possible carton blank for creating such a carton 220 is set forth in FIG. 10. The carton blank 300 generally has a structure of a fiberboard base with polyethylene coatings on the surfaces. Other film structures may employ the use of barrier layers, or nonscalping polymer coatings. The carton blank 300 is defined by various score lines that allow for folding of the blank 300 to create the carton 220 of FIGS. 6–9. A plurality of vertical score lines 305*a–h* separate the side walls 225*a–h* from each other. A lower horizontal score line 307 separates the side walls 225*a–h* (which be designated side panels in the blank form) from a plurality of bottom panels 309*a–i*.

An upper horizontal score line 311 separates the side walls 225*a–h* from a plurality of top panels 228*a–i*. A fin horizontal score line 317 separates the plurality of top panels 228*a–i* from the plurality of fin panels 224*a–i*. The top fin 224 is formed by the top fin panels 324*a*, 324*d*, 324*e*, 324*h* and 324*i*. The top fin panels 324*a*, 324*d*, 324*e*, 324*h* and 324*i* all have a maximum length that is greater than that of the top fin panels 324*b*, 324*c*, 324*f* and 324*g*. The unique top fin panel arrangement allows for the forty-five degree off-set sealing of the carton 220.

A plurality of diagonal score lines 357*a–f* define an integrated pour spout area of the carton 220. To access the contents of the carton 220, the integrated pour spout is readied by tearing open the carton 220 at the top panels. In opening the pour spout, the top fin 224 is split in two by the consumer. It is further contemplated that a fitment, not shown, may be attached to the carton 220 for accessing the product.

Top fin 224 defines a central plane of the carton 220 extending from the top to the bottom of the carton 220 with the top fin 224 lying on the central plane. The carton 220 has an octagonal cross-section. In such an embodiment, if apex 233*a* is at zero degrees, then each of the other apices and edges would have the following rotational coordinates: edge 231*d*, forty-five degrees; apex 233*d*, ninety degrees; edge 231*c*, one hundred thirty-five degrees; apex 233*c*, one hundred eighty degrees; edge 231*b*, two hundred twenty-five degrees; apex 233*b*, two hundred seventy degrees; and edge 231*a*, three hundred fifteen degrees.

The inverse pyramidal bottom 226 is formed from a plurality of bottom panels 309*a–i*. Flaps 309*e*, 309*f*, 309*a*, 309*b* are folded inward first while flaps 309*c*, 309*d*, 309*g*, 309*h* and 309*i* are folded on top thereof to form the inverse pyramidal bottom 226. For each bottom corner 235*a–d*, there is a bottom inverse apex 243*a–d*. As mentioned previously, the top fin 224 is in alignment with the bottom corner 235*a*.

A possible method and apparatus of forming the forty-five degree off-set top seal carton 20 of the present invention is illustrated in FIG. 11. The machine 400 includes a bottom forming station 500 where the bottom of the carton 20 is fabricated in a conventional manner. This usually occurs on a mandrel wheel where an erected carton blank is set upon a mandrel, pre-folded, heated, and then pressed together for sealing. One of the benefits of the present invention is that the bottom may be formed in a traditional manner. The only major adjustment to a packaging machine would be to the conveyor line 502 that must receive, hold and transport the cartons 20 at an angle, to the various stations on machine 400. One possible adjustment would be to have the carton pockets 505 on the conveyor line 502 in a diamond shape. In this manner, the cartons 20 are transported to the sterilization station 507, the filling station 509 and the top sealing station 511 at the necessary forty-five degree angle. At the top sealing station 511, the top sealing jaws will operate in a conventional manner to seal the fill carton 20 to create the desire forty-five degree off-set top seal carton 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A gable-top carton comprising:

a bottom having a rectangular cross-section with a plurality of corners and defining a diagonal extending between opposing comers of the bottom;

a plurality of side panels connected substantially perpendicular to and extending upwardly from the bottom;

a gable top with an upstanding top fin, the top fin lying parallel to the diagonal extending between opposing comers of the bottom.

2. A gable-top carton comprising:

a bottom having a plurality of panels defining a square cross-section having corners and defining a diagonal extending between opposing corners;

a plurality of side panels connected substantially perpendicular to and extending upwardly from the bottom; and a gable top with an upstanding top fin, the top fin lying parallel to the diagonal extending between the opposing comers of the bottom.

3. The carton according to claim 2 wherein the carton has eight side panels connected to an inverse pyramidal bottom.

4. The carton according to claim 2 wherein the gable-top defines a square cross section defining a diagonal extending between opposing corners and wherein the gable-top diagonal is rotated forty-five degrees from the bottom diagonal.

5. The carton according to claim 2 wherein the carton is eight sided near the middle of carton between the bottom and the gable top.

* * * * *